US006055757A

United States Patent [19]

Carlsson

[11] Patent Number: 6,055,757

[45] Date of Patent: May 2, 2000

[54] PICTURE FRAME

[75] Inventor: Leif Carlsson, Allingsås, Sweden

[73] Assignee: IKEA International A/S, Humlebaek, Denmark

[21] Appl. No.: 08/894,277

[22] PCT Filed: Feb. 14, 1996

[86] PCT No.: PCT/SE96/00194

§ 371 Date: Aug. 14, 1997

§ 102(e) Date: Aug. 14, 1997

[87] PCT Pub. No.: WO96/25075

PCT Pub. Date: Aug. 22, 1996

[30] Foreign Application Priority Data

Feb. 17, 1995 [SE] Sweden ..... 9500597

[51] Int. Cl.[7] ..... G09F 1/12

[52] U.S. Cl. ..... 40/790; 40/739; 40/741

[58] Field of Search ..... 40/792, 794, 790, 40/791, 739, 741, 782, 785, 658, 648

[56] References Cited

U.S. PATENT DOCUMENTS 1,321,650 11/1919 Loewenthal ..... 40/782
3,465,461 9/1969 Price et al. ..... 40/741
4,974,351 12/1990 Ghislanzoni ..... 40/792

FOREIGN PATENT DOCUMENTS

0375237 A2 6/1990 European Pat. Off. .
2222523 3/1990 United Kingdom ..... 40/152

*Primary Examiner*—Cassandra H. Davis
*Attorney, Agent, or Firm*—Flehr Hohbach Test Albritton & Herbert LLP

[57] ABSTRACT

A picture frame (1) for carrying a picture (2) or the like, with or without the aid of glass (3) and/or backing (4), the frame (1) including the frame sections (5) kept together at their corner regions (6) by fastening members (7), there also being included pressure members (8) for urging the picture (2) against an edge portion (9) extending as a flange along the frame sections (5). The sections (5) forming the frame (1) may be pulled apart or pushed together a given distance in relation to each other in coaction with fastening members (7) during mounting and/or removal of the picture (1), the pressure members (8) on the sections being stamped out therefrom such as to form tongues (11) bent out from the section in a direction towards a picture (2) carried by the frame (1), these tongues (11) having a length suiting the frame in question such as to retain the picture (2) during mounting as the sections (5) are moved towards each other, while the tongues (11) resiliently urge the picture (2) against the edge portion (9) for positionally fixing it in the frame (1)

3 Claims, 6 Drawing Sheets

Fig. 14a
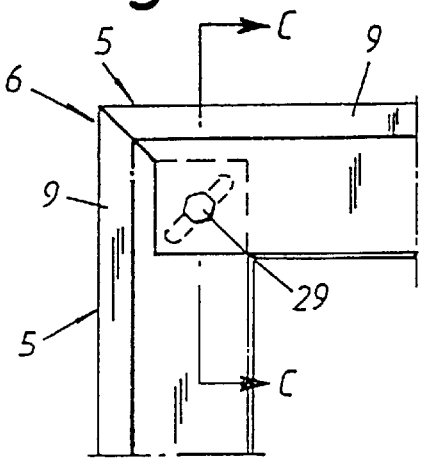
Fig. 14b
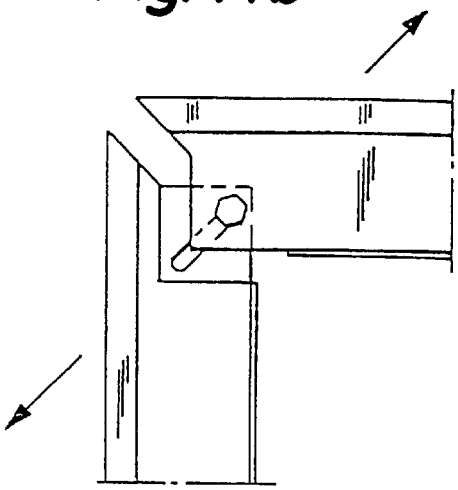
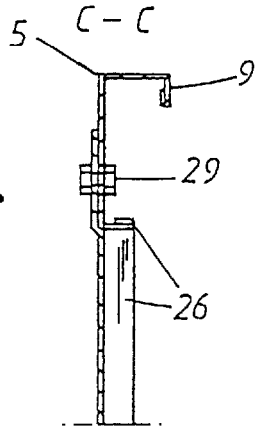
Fig. 14c
Fig. 14f
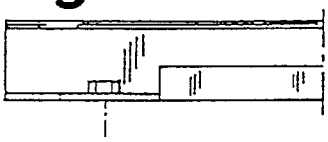
Fig. 14g
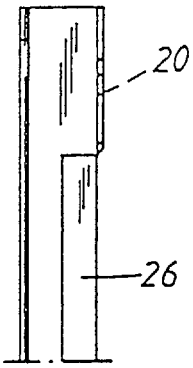
Fig. 14d
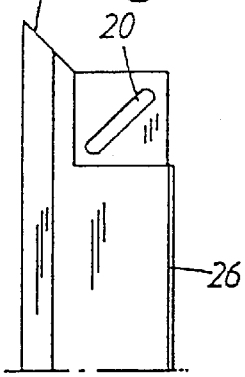
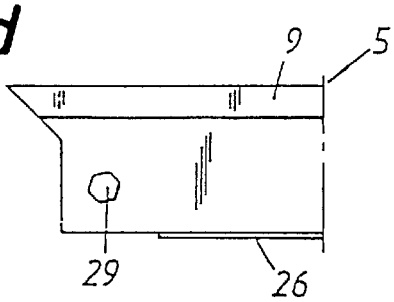
Fig. 14e Fig. 15a
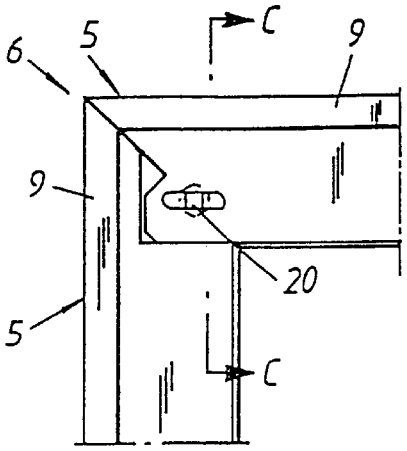
Fig. 15b
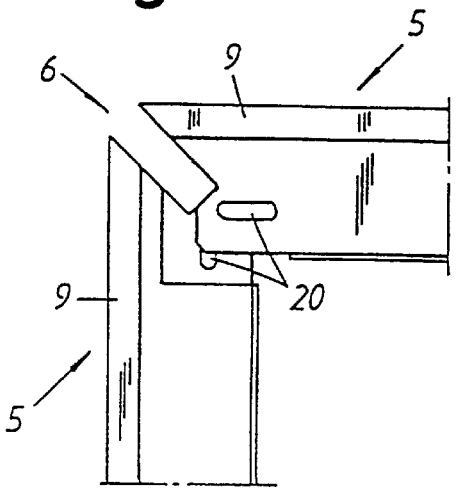
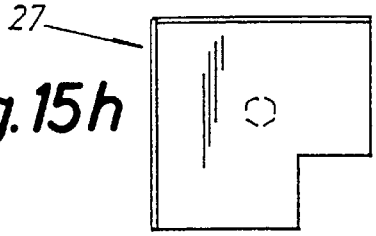
Fig. 15h
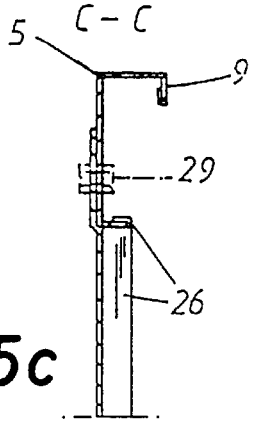
Fig. 15c
Fig. 15f
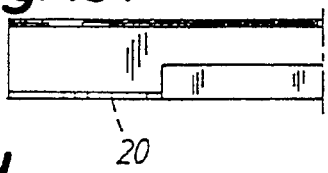
Fig. 15g
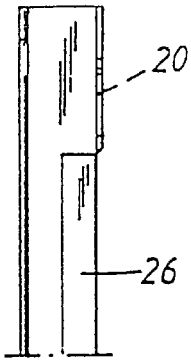
Fig. 15d
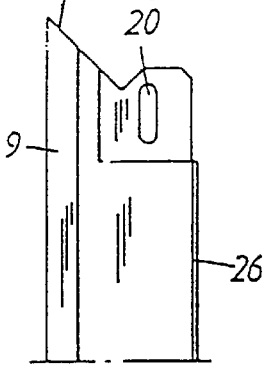
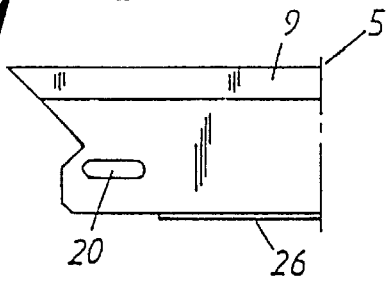
Fig. 15e

PICTURE FRAME

The present invention relates to a picture frame for carrying a picture or the like, with or without the aid of glass and/or backing, and comprises a frame moulding or section kept together at its corners by fastening means, there also being provided means for pressing the picture against a continuous edge portion of the section.

On the market today there is a plurality of implementation solutions for picture frames, all of which are made up in more or less complicated ways for mounting or removing a picture from the frame.

One object of the present invention is to achieve a picture frame, made up from few parts, and which may be opened using simple manual movements for the frontal insertion of a picture without the frame falling apart. When a picture is to be replaced, the frame shall be easy to open and close up again to its original ready-assembled state, with the frame sections pressed together.

Another object of the invention is that the frame shall include means ensuring effective pressure of the mounted picture against a continuous edge portion of the sections forming the frame, such that positive positional fixation of the picture in the frame is obtained.

With the aid of the invention there has now been achieved a picture frame complying excellently with the inventive objects, while it is furthermore both cheap and simple to produce. The distinguishing features of the invention are disclosed in the accompanying claims.

As a result of the invention there has now been obtained a picture frame, which is no longer burdened with the drawbacks to be found with those mentioned in the introduction. In addition, the inventive frame has enabled a simple mounting procedure for different types of picture or other similar items. For insertion of the picture the frame members are easily pulled away from each other sufficiently for permitting insertion of the picture from the front. After this the frame members can be pushed into mutual contact for positionally fixing the mounted picture, subsequent to which the fastening means at the corners of the frame are tightened, and the frame is then ready for hanging. Effective fixation of the picture in the frame is provided by tongues spring-biassed against the picture and integral with the frame section.

Figure 1A:
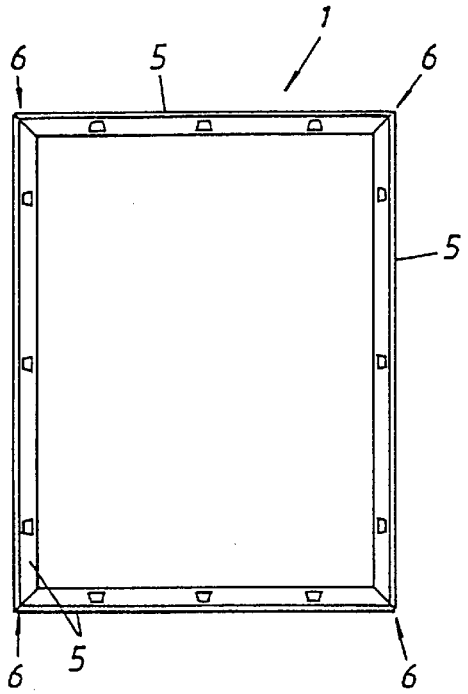
Figure 1B:
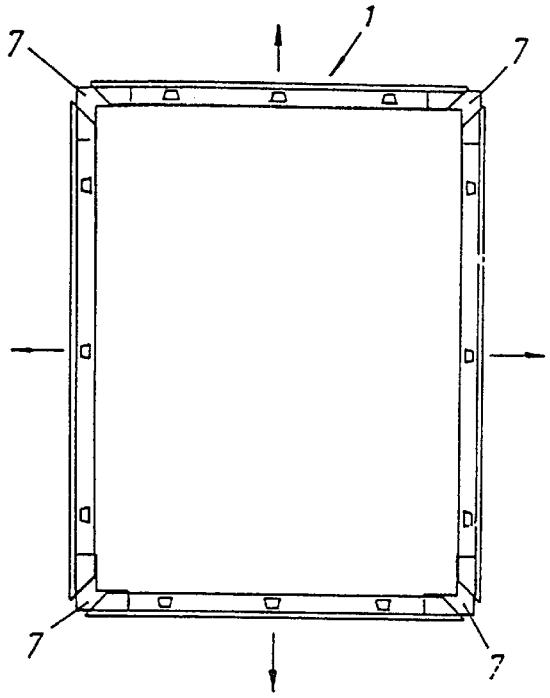
Figure 1C:
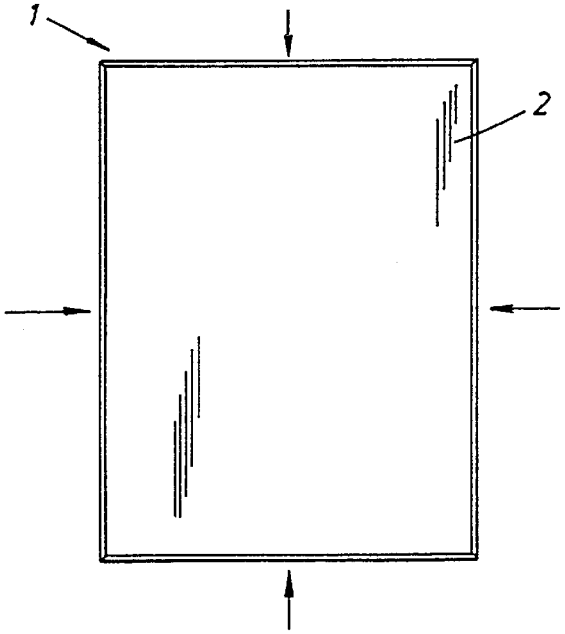
Figure 2:
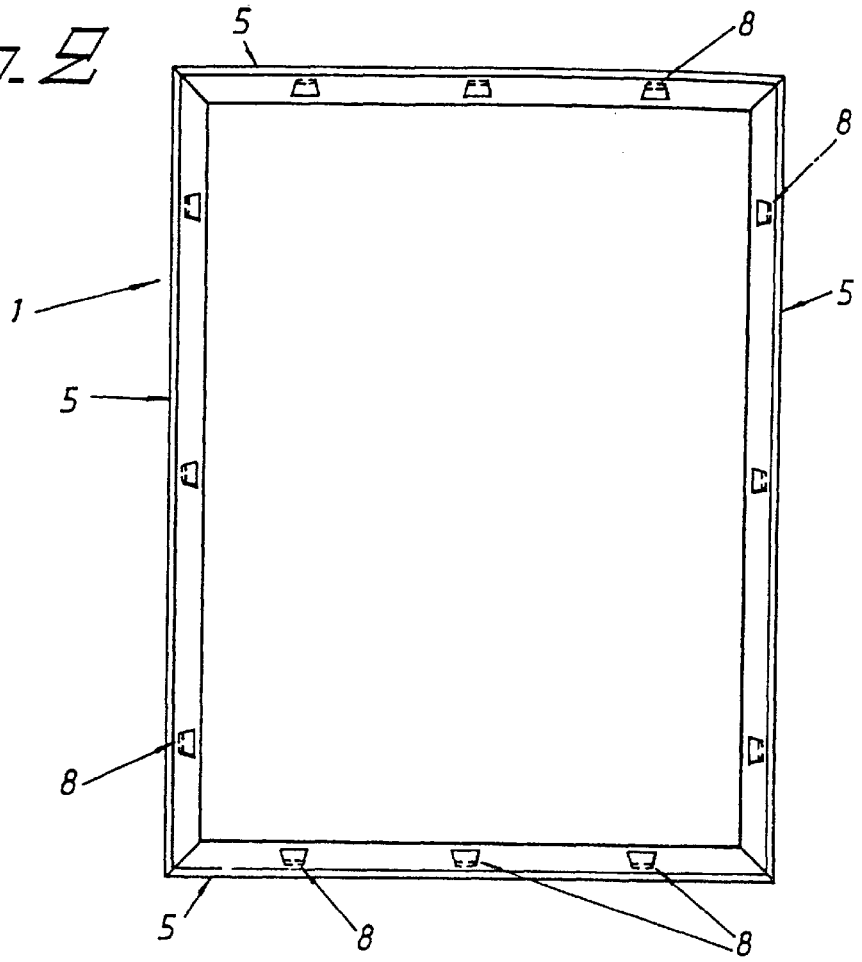
Figure 3:
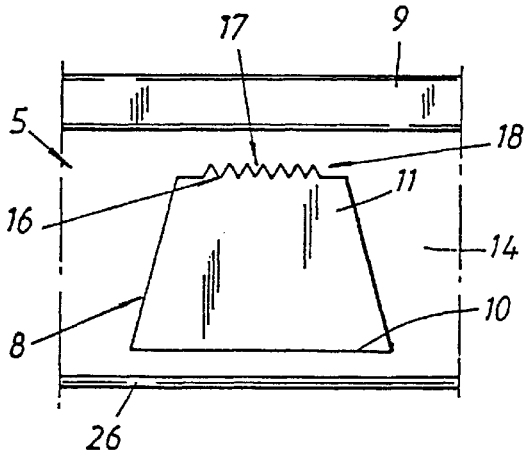
Figure 4:
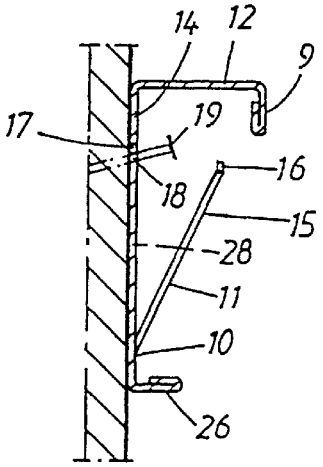
Figure 5:
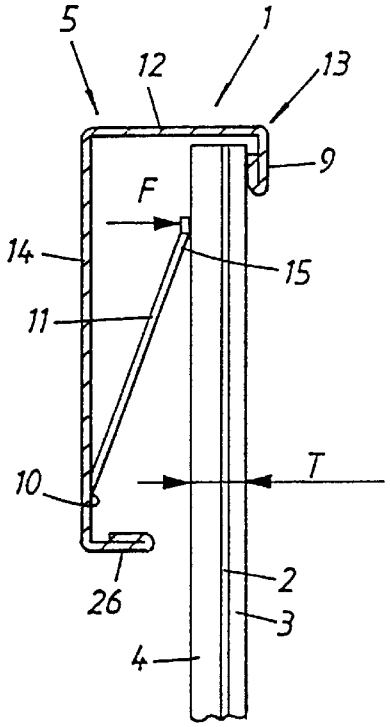
Figure 6:
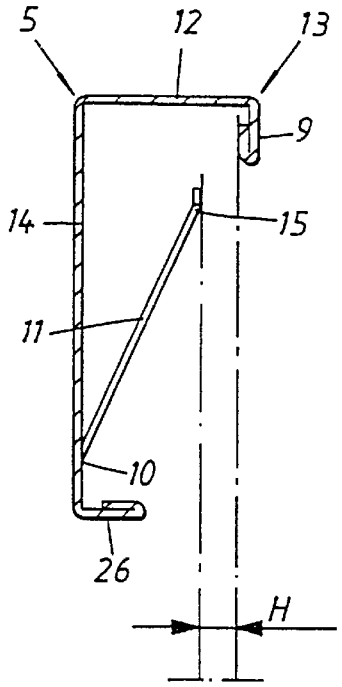
Figure 7:
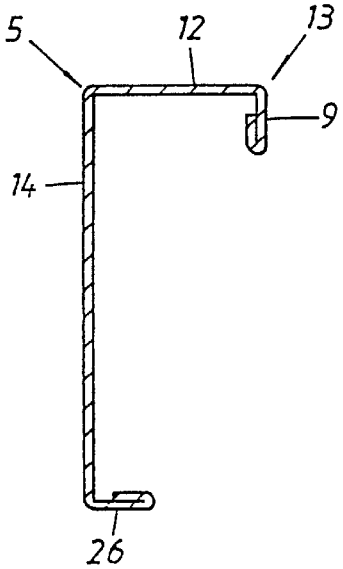
Figure 8:
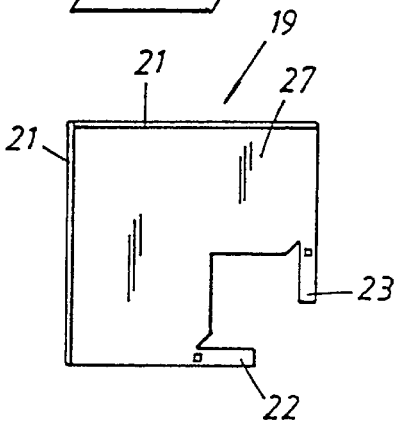
Figure 10:
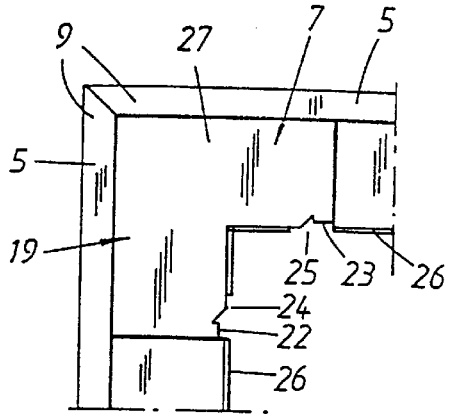
Figure 9:
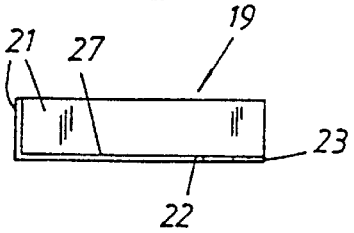
Figure 11:
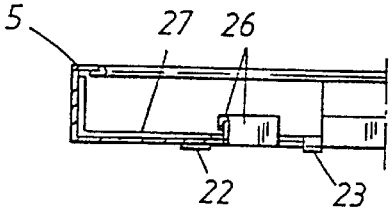
Figure 12:
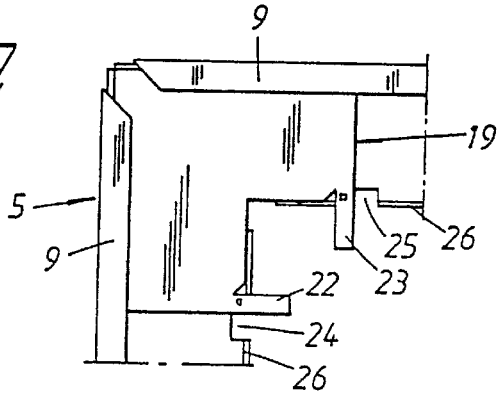
Figure 13:
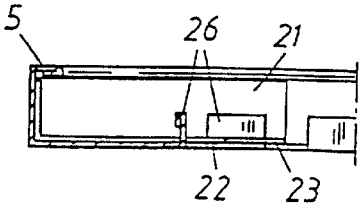

The invention will now be described below in more detail with the aid of some preferred embodiment examples, and with reference to the accompanying drawings, where FIGS. 1A–C illustrate the inventive picture frame and how it is utilized in mounting a picture, position A showing the frame without a picture, position B showing the frame pulled apart such as to permit frontal insertion of a picture, and position C showing the frame in its pushed-together state with a picture mounted in it and the assembly ready for hanging, FIG. 2 is a frontal view of the frame, and here will be seen the positions of tongues, which are stamped out of the frame sections, and are intended positionally to fix and retain a picture in the frame, FIG. 3 is a partial view of a frame section showing an opening stamped out on three sides to form a tongue bent away from the section, FIG. 4 is a side view of the detail in FIG. 3, FIG. 5 is a cross-section of the frame section, including a picture mounted between glass and backing, FIG. 6 is the same as FIG. 5, without a mounted picture, FIG. 7 is a cross-section of the frame section taken between two tongues, FIG. 8 is a plan of a corner clip, FIG. 9 is a front view of the clip in FIG. 8, FIG. 10 is a partial front view of the corner of an empty frame, showing a corner clip with its tabs turned down and locked against the frame section, FIG. 11 is a side view from the front of the detail in FIG. 10, FIG. 12 is a partial view of the detail in FIGS. 10 and 11, but with the tabs straight and the frame sections pulled apart for insertion of a picture, FIG. 13 is a side view of the detail shown in FIG. 12, FIGS. 14*a–g* are partial views of an alternative means for fastening and positionally fixing the corner portions of the frame, and FIGS. 15*a–h* are partial views of a further alternative means for fastening and positionally fixing the corner portions of the frame.

As will be seen from FIG. 1, the picture frame 1 in accordance with the present invention includes, in the illustrated embodiment example, four frame sections 5 kept together at their corners 6 by fastening means 7. In FIG. 1A the frame is in its pushed-together state and in FIG. 1B it is in its drawn-out state, when a picture 2 may be inserted from the front. In FIG. 1C the frame is shown in its pushed-together state and with the mounted picture ready for hanging.

As will be seen in more detail from FIG. 2, the frame 1 includes a plurality of tongues 11 formed as pressure means 8. These are stamped out on three sides from the frame sections 5 at given mutual spacing round the frame, the fourth side of the tongue being integral with the frame section.

As will be seen in more detail from FIGS. 3–7, the frame 1 not only includes the sections 5, held together at corners 6 by fastening means 7, but also the tongues 11 formed as pressure means 8 for urging the picture 2 against a continuous front edge portion 9 of the section 5. FIG. 5 shows how the picture 2, with glass on one side and backing 4 on the other, is mounted in the section 5. The tongues 11 made in the sections 5 are bent along a folding line 10 in a direction towards a picture 2 carried in the frame 1, and, according to FIG. 5, towards the backing 4. The tongues are provided with a resilient portion 15, and have a length suitable to the frame in question, so that spring bias is applied to the picture 2 or backing 4, such as to positionally fix the picture 2 against the section edge portion 9.

The figures furthermore illustrate how the frame sections 5 have a cross-section in an L shape in this embodiment example. At its free end 13 the short leg 12 of the L is folded at right angles in a direction towards the middle of the frame to form the previously mentioned end portion 9. The long leg 14 of the L forms the back of the frame 1 and contains the tongues 11 stamped out from it at given mutual spacing along the sections 5 such as to provide uniformly distributed pressure of the picture against the edge portion 9. The tongues 11 may be stamped out and bent away from the leg 14, with their free resilient portions 15 directed either transversely or longitudinally in relation to the frame section 5. In the preferred example illustrated in the figures, the resilient portion 15 of the tongues 11 is directed towards the shorter leg 12.

As will be seen in more detail from FIGS. 3 and 4, the free end portion 15 of each tongue 11 has a serration 16. There is also a complementary serration 17 formed in openings 28 in the frame section 5 when the tongue 11 is bent out. Suspension means 18 are thus obtained for the picture frame 1, and these are intended for coaction with hooks 19', or the like, affixed to a wall. In the example, illustrated in more detail in FIGS. 5 and 6, the tongue 11 is bent out from the long leg 14 at an angle of 5–45°.To obtain the right amount of force F against the mounted picture 2 the distance H is less than the thickness T of the picture 2 and/or glass 3 together with backing 4. In this example T may vary between 5 and 10 mm, depending on the type of glass and backing.

The fastening means 7 for keeping together the corner regions 6 of the frame sections may be either corner clips 19, or threaded means 29 displaceable in elongate holes 20 in the sections 5, such as to enable pulling apart adjacent sections a distance substantially corresponding to the width of edge portion 9, thus to facilitate quick and easy insertion of picture 2 from the front, without the sections making up the frame falling apart.

The corner clips 19 in the preferred example consist of a thin, angularly shaped plate 27 with the long edges flanged, the flanges 21 having a height suited to the inside distance between the long side 14 and edge portion 9 of the frame sections 5. At its shorter sides, each remote from a flanged side, the plate is provided with tabs 22, 23 extending towards each other and each parallel to its respective remote long side. These tabs are displaceably accommodated in openings 24, 25 in an inner flange 26 disposed at the free end of the long leg 14 of the respective frame section 5, and may be folded down round the long leg 14 to lock the frame corner 6.

The appearance of the clip and how it is fitted may be seen in FIGS. 8–13.

Two further embodiments of the fastening means 7 for keeping together the frame sections 5 at the corners 6 are shown in FIGS. 14*a–g* and 15*a–h*. In these two, elongate holes 20 are used, with threaded fastening means 29 displaceable in the frame sections, for enabling pulling apart and pushing together the sections 5 of the picture frame 1.

I claim:

1. A picture frame for carrying a picture, the picture frame comprising a plurality of frame sections formed with flanges having edge portions and corners, a fastener structure which mounts the sections together at the corners, the fastener structure comprising a recessed opening formed in at least one of the edge portions which is adjacent each corner, the fastener structure further comprising at least one engagement device which is orthogonal with said one edge portion, the engagement device extending into releasable insertion with, and back and forth movement along, the recessed opening, said recessed opening having a length which enables relative movement of the engagement device along the recessed opening through a maximum distance which is sufficient to enable the sections to be manually pulled apart no greater than said distance for allowing replacement of the picture into the frame without separation of the frame sections.

2. Frame as claimed in claim 1, characterized in that said engagement devices comprise a plurality of tongues (11) which are bent out from the frame sections (5) at an angle of 5–45°, from which they are deflectable towards the frame sections (5) when inserting a picture (2) in said frame (1), such as to spring back again for pressing the picture (2) against the frame edge portion (9).

3. A picture frame as in claim 1 in which the engagement device comprises a corner clip having a base and at least one tab, said one tab extending orthogonal with the base and into said releasable insertion with said recessed opening.

* * * * *